US010877441B2

(12) United States Patent
David

(10) Patent No.: US 10,877,441 B2
(45) Date of Patent: Dec. 29, 2020

(54) TIMEPIECE COMPRISING A NEAR FIELD COMMUNICATION DEVICE

(71) Applicant: BULGARI HORLOGERIE SA, Neuchâtel (CH)

(72) Inventor: Jérôme David, Cudrefin (CH)

(73) Assignee: BULGARI HORLOGERIE SA, Neuchatel (CH)

( * ) Notice: Subject to any disclaimer, the term of this patent is extended or adjusted under 35 U.S.C. 154(b) by 294 days.

(21) Appl. No.: 15/193,828

(22) Filed: Jun. 27, 2016

(65) Prior Publication Data

US 2017/0003660 A1 Jan. 5, 2017

(30) Foreign Application Priority Data

Jul. 1, 2015 (EP) ..... 15174746

(51) Int. Cl.

| | |
|---|---|
| ***G04R 20/26*** | (2013.01) |
| ***G04R 60/08*** | (2013.01) |
| ***G04G 21/04*** | (2013.01) |
| ***G04R 60/10*** | (2013.01) |
| ***G04B 19/28*** | (2006.01) |

(52) U.S. Cl.

CPC ..... *G04R 20/26* (2013.01); *G04B 19/283* (2013.01); *G04G 21/04* (2013.01); *G04R 60/08* (2013.01); *G04R 60/10* (2013.01)

(58) Field of Classification Search

CPC .... G04B 43/007; G04B 19/283; G04R 60/08; G04R 60/10; G04R 20/26

See application file for complete search history.

(56) References Cited

U.S. PATENT DOCUMENTS

| | | | | |
|---|---|---|---|---|
| 5,798,984 | A * | 8/1998 | Koch | G04G 21/04 343/718 |
| 9,778,623 | B2 | 10/2017 | Nishihara | |
| 2004/0155818 | A1* | 8/2004 | Barras | G04G 21/04 343/700 MS |
| 2012/0320715 | A1* | 12/2012 | Maruyama | G04R 60/12 368/10 |
| 2014/0179242 | A1 | 6/2014 | Liao | |
| 2014/0225786 | A1 | 8/2014 | Lyons et al. | |
| 2015/0168920 | A1 | 6/2015 | Nishihara | |

(Continued)

FOREIGN PATENT DOCUMENTS

| | | | |
|---|---|---|---|
| CH | 690525 | A5 | 9/2000 |
| CH | 701919 | A2 | 4/2011 |

(Continued)

OTHER PUBLICATIONS

European Third Party Observations dated Jul. 14, 2017 in corresponding European application No. EP15174746.6 (with English machine translation; 6 pages).

(Continued)

*Primary Examiner* — Sean Kayes

(74) *Attorney, Agent, or Firm* — Westerman, Hattori, Daniels & Adrian, LLP

(57) ABSTRACT

The invention concerns a timepiece (35) provided with a dial (1) and/or a bezel (2) comprising a near field communication device (4) able to receive/send a signal, said communication device (4) being arranged in the area of the dial (1) or the bezel (1) of said timepiece (35) and being associated with a magnetic screen (8), especially one made of ferrite.

11 Claims, 4 Drawing Sheets

(56) References Cited

U.S. PATENT DOCUMENTS

| | | | | |
|---|---|---|---|---|
| 2016/0205229 | A1* | 7/2016 | Vincent | H01Q 1/273<br>455/575.7 |
| 2016/0323428 | A1* | 11/2016 | Kim | G06F 1/1658 |

FOREIGN PATENT DOCUMENTS

| | | | |
|---|---|---|---|
| CN | 1190858 | A | 8/1998 |
| CN | 104466363 | A | 3/2015 |
| CN | 104731724 | A | 6/2015 |
| EP | 0884661 | A2 | 12/1998 |
| EP | 0884662 | A2 | 12/1998 |
| EP | 1892651 | B1 | 8/2008 |
| JP | 2008-298585 | A | 12/2008 |
| JP | 2013-015320 | A | 1/2013 |
| JP | 2013-15320 | A | 1/2013 |
| JP | 2013-197786 | A | 9/2013 |

OTHER PUBLICATIONS

European Office Action dated Dec. 13, 2017 in corresponding European application No. EP15174746.6 (with English machine translation; 11 pages).

European Search Report and Written Opinion dated Jan. 20, 2016 issued in counterpart European application No. EP15174746; w/ English partial translation and partial machine translation (18 pages).

Chinese Office Action and Search Report dated Jul. 18, 2019 in corresponding application No. CN201610651765.0 (with English machine translation; 15 pages) (D3, JP2008298585 and D4, JP20131977986 (also cited on p. 1) cited in the Chinese search report are not listed in this IDS since they were already listed in the IDS filed Jun. 28, 2016).

* cited by examiner

TIMEPIECE COMPRISING A NEAR FIELD COMMUNICATION DEVICE

The invention concerns a timepiece provided with an automatic, mechanical or electronic movement such as a quartz movement comprising a near field communication device of NFC or RFID type, the communication device having an electronic chip connected to an antenna.

It is known in the prior art how to equip a timepiece with a near field communication device in order to improve its tracking throughout the course of its lifetime or to fight against the piracy to which it might be subjected. In the course of its operation, the communication device is able to connect to an associated peripheral when it finds itself at a close distance from the latter and to send it a radio signal regarding information about it.

Generally speaking, in the prior art such a communication device is disposed inside components of the timepiece such as the casing, the caseband, the wristband, or even the glass.

However, one major drawback of such a communication device so arranged in the timepiece is due to the fact that it often suffers from a lack of reliability. In fact, the particular arrangement of this communication device in components of the timepiece which are essentially metallic produces much electromagnetic perturbation. Such perturbation results from reflection and/or absorption of signals emitted by the communication device when it is in proximity to the peripheral. This perturbation is liable to cause malfunctions in the context of establishing a connection with the peripheral or maintaining this connection.

To mitigate this drawback, it is common in the prior art to use a communication device having an antenna of large size.

However, the integration of such an antenna in the timepiece and in particular in its components is a complex and tedious operation. What is more, such an integration makes difficult any subsequent intervention in the timepiece in order to provide for its upkeep and/or repair.

The present invention intends to mitigate such drawbacks connected to the timepieces of the prior art.

In this design, the timepiece provided with a dial and/or a bezel comprising a near field communication device able to receive/send a signal, said communication device comprising a chip and an antenna and being arranged in the area of the dial or the bezel of said timepiece and the communication device being associated with a magnetic screen, especially one made of ferrite.

In other embodiments:

- when the communication device is arranged in the area of the dial, the dial has a lower surface on which is arranged said communication device;
- when the communication device is arranged in the area of the dial, the dial has a lower surface provided with a pocket in which said communication device is arranged;
- when the communication device is arranged in the area of the dial, the dial has an upper surface on which said communication device is arranged;
- when the communication device is arranged in the area of the dial, the dial has upper and lower surfaces between which said communication device is arranged;
- when the communication device is arranged in the area of the bezel, the bezel is a monobloc piece comprising a lower surface having a pocket in which said communication device is arranged;
- the magnetic screen of a signal is situated on a lower surface of the dial so as to close an opening formed by a pocket on the lower surface when the communication device is arranged in the area of the dial or the magnetic screen is situated on a lower surface of the bezel so as to close an opening formed by the pocket on the lower surface when the communication device is arranged in the area of the bezel;
- the bezel comprises first and second components, the second component comprising a second interior surface provided with a pocket able to receive said communication device;
- the magnetic screen of a signal is situated on a bottom wall and/or a lateral wall of the pocket;
- the dial and/or the bezel are each made of a material having no electrical conductivity properties;
- the magnetic screen comprises at least one layer and/or one plate and/or one film and/or one metallic deposit, especially of ferrite;
- the communication device comprises a substrate made of plastic or laminated composites on which are glued an electronic chip and an antenna, and
- the communication device is of the NFC or RFID technology type.

Other advantages and characteristics of the invention will become more apparent from a reading of the following description of two preferred embodiments, making reference to the figures, shown for illustration and not for limitation:

Figure 9:
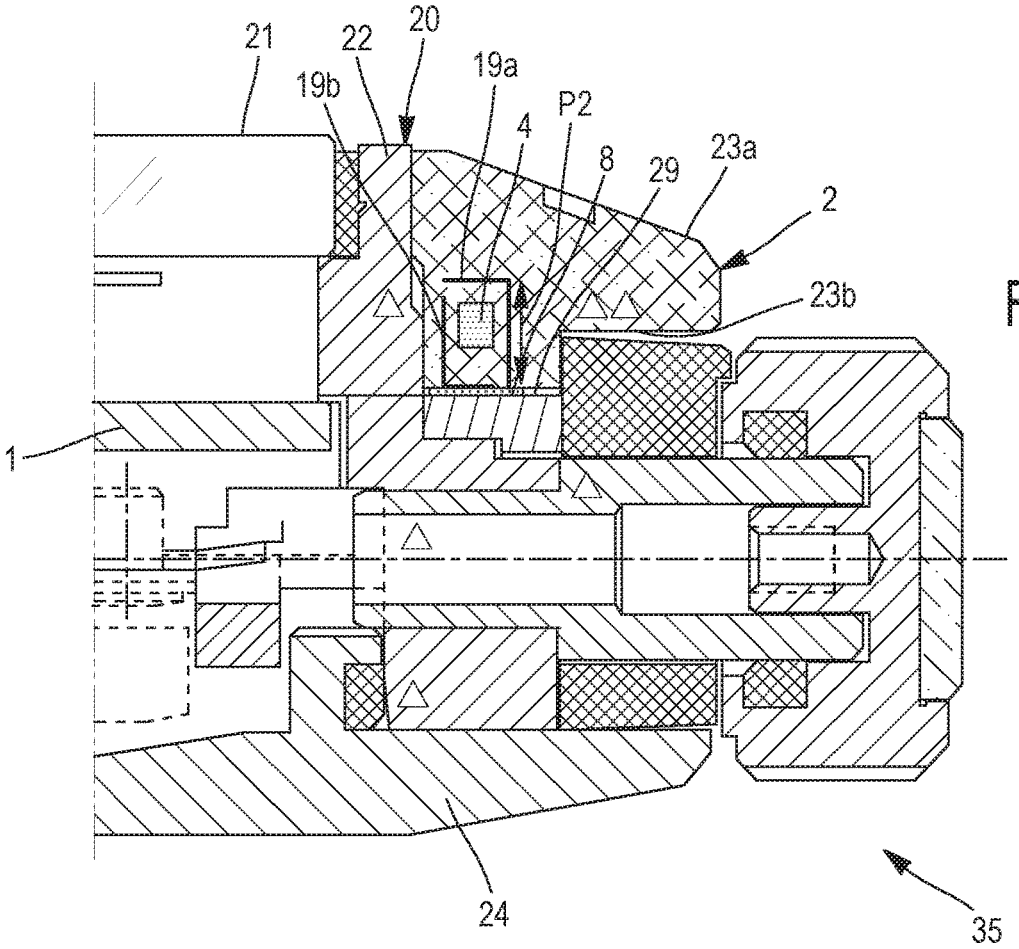
FIG. 9 represents a sectional view of a case of the timepiece comprising a first variant of a bezel according to a second embodiment of the invention.

In the present invention, the timepiece 35 is provided with a case 20 having a caseband 22 and a bottom 24, visible in FIG. 9. The case 20 of this timepiece 35 is able to receive an automatic, mechanical or even electronic movement such as a quartz movement. This movement is topped by a dial 1 and a set of hands on top of which is placed a glass 21. This timepiece 35 likewise comprises a bezel 2 which can be fixed or rotary and which is preferably disposed in the area of the edge of the caseband 22.

FIGS. 1 to 10 describe embodiments of the timepiece 35 comprising a near field communication device 4 able to send/receive a signal, as well as a magnetic screen 8.

More precisely, in FIGS. 1 to 8 a first embodiment of the timepiece 35 comprises the communication device 4 arranged in the area of the dial. In a second embodiment of this timepiece 35, represented in FIGS. 9 and 10, the communication device 4 is located in the area of the bezel 2 of the timepiece 35.

This communication device 4 implements, for example, wireless communication technologies of short range and high frequency of the NFC type (Near Field Communication) or RFID type (Radio Frequency Identification). This communication device 4 operates preferably in the high frequencies HF, for example at 13.56 MHz. But in other variants, it can operate in the following frequency bands:

- low frequencies LF, for example between 125 kHz and 134.2 kHz;
- ultrahigh frequencies UHF, for example between 860 MHz and 960 MHz;
- superhigh frequencies SHF, for example at 2.45 GHz.

Such technologies thus allow the timepiece 35 to exchange information at short distances with other associated peripherals. Such distances can lie between around 0 and 20 cm, preferably between 0 and 2 cm. This communication device 4 can be the passive type with energy furnished to it by the radio frequencies emitted by each associated peripheral. In other words, this communication device 4 functioning in the passive type, uses an electric induction mechanism in the chip to be powered. Moreover, it will be notice that unlike to the Bluetooth technology, the communication device allows transfers of very limited data volumes and at very close range. These transfers are controlled and allow high security.

Such short distances between the timepiece 35 and each associated peripheral make it possible to avoid any involuntary activation of establishing a connection between the latter and likewise help limit all attempts at an unauthorized connection which may result from acts of piracy.

More precisely, this near field communication device 4 comprises an electronic chip 6 and at least one antenna 5. The chip 6, which is connected to said at least one antenna 5, contains hardware and software elements. In this context, the hardware and/or software elements of the chip 6 of the device 4 comprise more precisely at least one microprocessor 13*a* cooperating with memory elements 13*b*. This chip 6 may be able to execute program code instructions to implement a computer program. The memory elements 13*b* of this chip 6 can save data regarding information about the timepiece 35 or about the wearer of this timepiece. It will be noted that in one alternative the communication device 4 can contain a substrate 16 made of plastic or laminated composites on which the chip 6 and the antenna 5 are glued.

In this timepiece 35, the magnetic screen 8 also known as a magnetic shielding element has a magnetic permeability adapted to the frequency bands of the magnetic field generated by the communication device 4. For example, when the communication device 4 is operating in the high frequency HF band, the magnetic screen 8 has a strong initial magnetic permeability $\mu'$ with $\mu'>100$ and low magnetic losses $\mu''$ with $\mu''<7$, and preferably a magnetic permeability $\mu'$ of 150 and magnetic losses $\mu''$ of 5.

Such a magnetic screen 8 preferably has an electrical resistivity greater than 1000 KΩ/m and a thickness between 50 and 200 ρm, and preferably 180 μm.

The magnetic screen 8 can preferably be made of metallic material, such as ferrite.

This magnetic screen 8 makes it possible to avoid a modification of the magnetic field sent or received by the communication device, which modification would be due to the presence of various metallic components 33 situated in the immediate surroundings of the communication device 4 such as the case 20 or even the movement of the timepiece 35. In fact, the magnetic screen 8 tends to be able to lessen the negative influence which these metallic components 33 might have on the performance of the communication device 4. This negative influence might involve the attenuation of the magnetic field generated or received by this communication device 4.

More precisely, FIG. 9A illustrates a schematic representation of a timepiece 31 comprising the communication device 4 arranged in the area of the bezel 1 and/or the dial 2 and metallic components 33 such as the case 20 or also the movement. This timepiece 31 is different from that of the invention in that it lacks the magnetic screen 8. In this configuration, when the communication device 4 generates a magnetic field characterized by the lines of magnetic flux, these lines pass through the zones of this or these metallic components 33 situated in the immediate surroundings of the communication device 4. The variations of this magnetic field passing through these metallic components 33 are liable to create the appearance of electric currents known as "Foucault currents" in these zones. The creation of such electric currents in these zones has the effect of attenuating the strength of this magnetic field.

In FIG. 9B, the timepiece 35 comprises, in addition to the communication device 4 and metallic components 33, the magnetic screen 8, as is the case in the present embodiment of the invention. This magnetic screen 8 is arranged between the communication device 4 and the metallic component(s) 33 which are in the immediate surroundings of this device 4, according to different configurations described below. Under these conditions, when the communication device 4 generates a magnetic field, the latter does not pass through the zones of this or these metallic components 33 situated in the immediate surroundings of the communication device 4. In fact, the magnetic screen 8 is able to channel this magnetic field by modifying the lines of magnetic flux resulting from this field, so that these lines do not pass through the metallic components 33. Thus, this or these metallic components 33 are then magnetically isolated from the magnetic field generated by the communication device 4. In other words, the magnetic screen 8 is able to separate the timepiece 35 into two zones, a first zone containing the magnetic fields generated by the communication device 4 and a second zone not exposed to these magnetic fields thanks to the action of the magnetic screen 8.

Thus, this magnetic screen 8 makes it possible to improve the efficiency and the sensitivity of the reception/transmission of radio signals by the antenna 5 of the communication device 4 by isolating this antenna 5 from the metallic components 33 comprised in its immediate surroundings.

It will be noted that this magnetic screen 8 can be flexible or rigid and can contain at least one layer, one plate, one film or one metallic deposit, preferably of ferrite or also a polymer resin ballasted with metallic particles of ferrite. Such a magnetic screen 8 is thus of small footprint.

In the timepiece 35, the magnetic screen 8 is associated with the communication device 4 by being arranged in the timepiece 35 relative to this communication device 4, or relative to this communication device 4 and at least one metallic component 33 of said timepiece 35 comprised in the immediate surroundings of the communication device 4. In the different variants of the two embodiments described below, the magnetic screen 8 is associated with the communication device 4 by being arranged relative to the latter such that there is a spacing of around 0 to 2500 μm defined between them and/or that this magnetic screen 8 is disposed between the communication device 4 and at least one electrical component 33 comprised in the immediate surroundings of said device 4.

It will be noted that when the spacing between the magnetic screen 8 and the communication device 4 is basically zero, the magnetic screen 8 can then be associated with the communication device 4 by producing the magnetic screen with a technique of printing, silk screening, gluing or vapour deposition of a metallic paint onto a support contained or mounted in the communication device 4. One will then choose a support having excellent electrical insulation properties. This support can be a layer of material, a film, a band, etc. In this configuration, this support can be located solely in the area of the antenna 5 of the communication device 4 or also in the area of the antenna 5 and the chip 6.

As an example, this magnetic screen 8 is associated with the communication device 4 by being arranged in the timepiece 35 beneath this communication device 4, that is, between the movement constituting a metallic component 33 of said timepiece 35 and this communication device 4. In this configuration, the magnetic screen 8 is associated with the communication device 4 by not being in direct contact with the antenna 5 of the communication device 4, but rather being able to be in contact with the chip 6.

As we have mentioned above, in the first embodiment of the timepiece 35 the communication device 4 is arranged in the area of the dial 1. This first embodiment comprises four variants of dial 1 where the communication device 4 is arranged. One such dial 1 is of a monobloc design. It is made preferably of rigid material able to provide good strength, and a proper appearance of the display. What is more, this material has no electrical conductivity properties and it can be made for example of synthetic sapphire, ceramic, or also an injection moulded or cast polymer such as polyamide-nylon PA12, polycarbonate PC or polyphenylsulfone PPSu.

This dial 1 which is preferably of circular shape comprises an upper surface 11*a* constituting a visible display surface being opposite a lower surface 11*b* situated opposite the movement of said timepiece 35.

The dial 1 likewise contains a peripheral wall 25 joining the lower and upper surfaces 11*b*, 11*a* to each other. It will be noted that the upper and lower surfaces 11*a*, 11*b* can be parallel to each other and that the intersections between the peripheral wall 25 and each of these surfaces 11*a*, 11*b* define the peripheral edges 27*a*, 27*b*.

This dial 1 can comprise feet 34, which are used as a geometrical reference in the manufacturing process of the dial and also to secure this dial 1 to the case 20 and/or to the movement. The case 20 and/or the movement then comprise orifices in which these feet 34 are engaged when the dial 1 is assembled with the case 20 and/or with the movement. Fixation elements such as screws engaging in threaded holes transversely to the orifices make it possible to ensure a mechanical connection between the dial 1 and the case 20 and/or the movement. These feet 34 can be arranged in the area of the lower surface 11*b* of the dial (visible in FIGS. 1, 2 and 4) and/or in the area of the peripheral wall 25 (visible in FIGS. 5 and 6). Such feet 34 can correspond to lugs, for example.

This upper surface 11*a* can have, in the area of a peripheral zone, time indicating markings 7, such as hour and minute markings 7. These markings 7 can be indexes or digits (Roman or Arabic), or decorative elements such as small precious or semiprecious stones, or a combination of two or three of the latter. The dial 1 likewise has an axial passage orifice 10 through which passes one free end of a shaft connected to a kinematic chain of the movement, able to carry the hands of the timepiece 35 above the upper surface 11*a*. The dial 1 also comprises an opening 9 through which information pertaining to the date can be displayed.

In the first variant of the dial 1, illustrated in FIGS. 1 to 4, the communication device 4 is arranged on the lower surface 11*b* of the latter. More precisely, in this variant the lower surface 11*b* comprises a pocket 3 in which the communication device 4 can be mounted. This pocket 3 is defined in this lower surface 11*b* around the axial passage orifice 10 of the dial 1. This pocket 3 has a wall 15*a* forming a bottom of the pocket 3 hereinafter called the bottom wall 15*a*, and a lateral wall 15*b*, the lateral wall 15*b* being preferably perpendicular to the bottom wall 15*a*. The bottom wall 15*a* and the lateral wall 15*b* each have an essentially planar surface. The surface of the bottom wall 15*a* is comprised in a plane parallel to a portion 12 of the lower surface 11*b* not forming this pocket 3, or parallel to the upper surface 11*a*.

The lateral wall 15*b* of this pocket 3 forms with the portion 12 of the lower surface 11*b* an edge 26 which defines an opening of the pocket 3.

Figure 1:
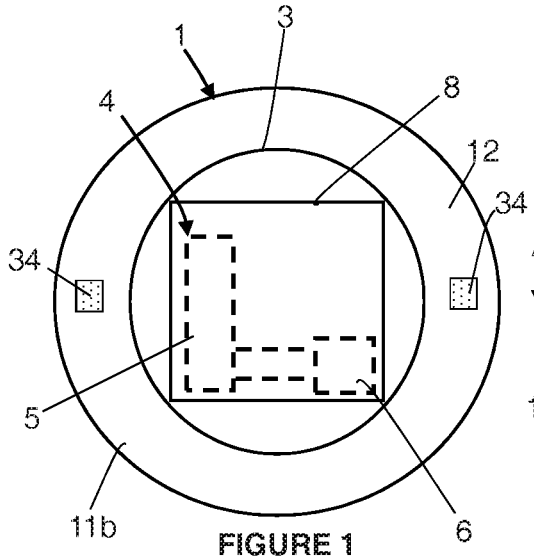
FIG. 1 is a schematic representation of a first variant of a dial of a timepiece comprising a communication device according to a first embodiment of the invention.
Figure 3:
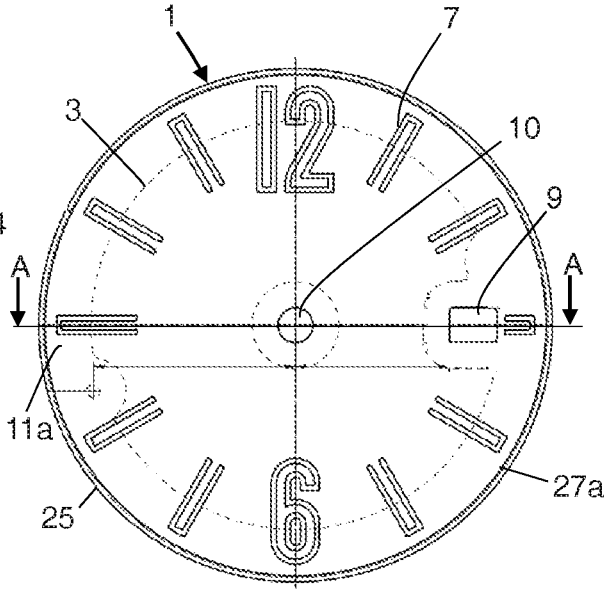
FIG. 3 is a view of an upper surface of the first variant of the dial according to the first embodiment of the invention.
Figure 2:
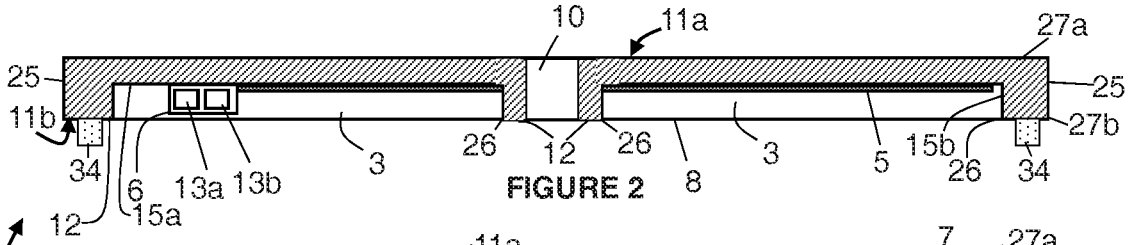
FIG. 2 is a schematic representation of a sectional view of the first variant of the dial according to the first embodiment of the invention.
Figure 4:
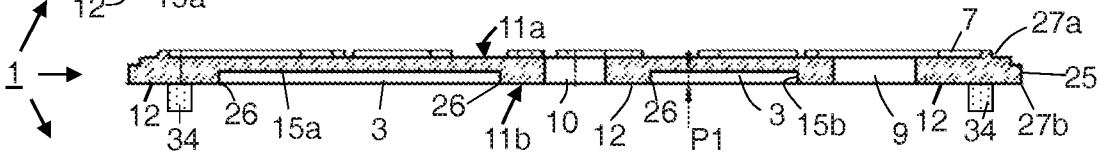
FIG. 4 is a sectional view AA of the first variant of the dial illustrated in FIG. 3.

Referring to FIG. 3, this pocket 3 can have a general circular shape. In fact, it can have a zone forming a recess about the opening 9 made in the dial 1 for the display of information regarding the date.

In this variant, this pocket 3 is defined on around 40 to 90% of the lower surface 11*b*, and preferably on 80% of this surface. Moreover, this pocket 3 has a depth P1 of around 300 to 500 μm, preferably 400 μm.

The communication device 4 comprising the chip 6 connected to at least one antenna 5 is disposed in the pocket 3 formed in the dial 1. More precisely, the chip 6 and the antenna 5 can be fixed to the bottom wall 15*a* by gluing or also by fitting into fixation elements present on this bottom wall 15*a* of the pocket 3. Alternatively, the antenna 5 can be disposed on this bottom wall 15*a* by printing, silk screening, or vapour deposition of a metallized paint.

In this variant of the dial 1, the alternative of the communication device 4 comprising the substrate 16 made of plastic or laminated composites on which the chip 6 and the antenna 5 are glued can likewise be arranged in this pocket 3, especially by gluing.

In this variant of the dial 1, when the communication device 4 is associated with the magnetic screen 8, the opening of the dial 1 is wholly or partly closed by this magnetic screen 8. This magnetic screen 8 comprises a zone of fixation which is mechanically connected by gluing, fitting, or welding to the edge 26 of the opening of the pocket 3, namely, the portion 12 of the lower surface 11*b* not constituting the pocket 3. Alternatively, the magnetic screen 8 can have a shape essentially complementary to that of the opening so as to be able to be arranged there by fitting and thus cover all or part of this opening of the pocket 3. In this case, the magnetic screen 8 is preferably rigid and the edge 26 of the opening comprises a fitting zone able to cooperate with the contour of the magnetic screen 8.

Such an arrangement of the communication device 4 in this pocket 3 makes it possible to limit the footprint of this device 4 in the case 20 of the timepiece 35 so as not to disturb the functioning of the movement.

Figure 5:
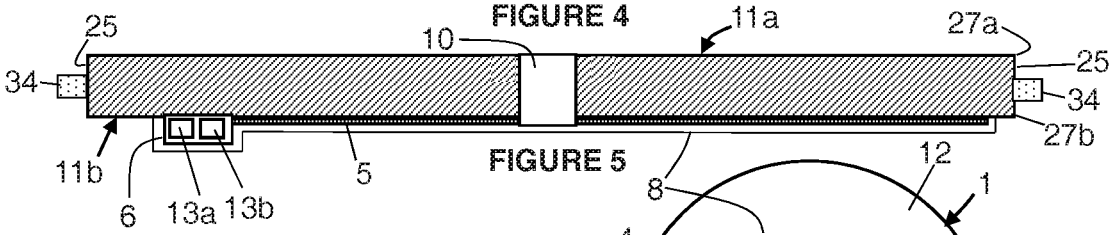
FIG. 5 is a schematic representation of a sectional view of a second variant of the dial according to the first embodiment of the invention.
Figure 6:
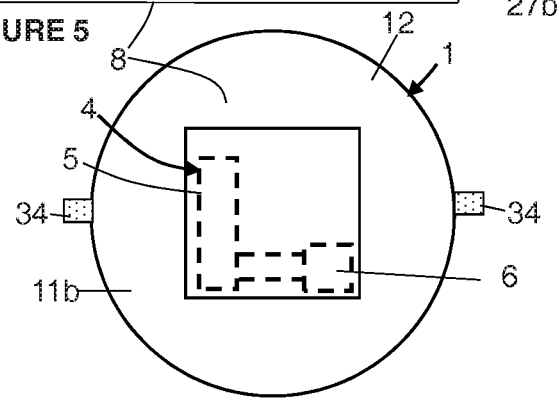
FIG. 6 is a schematic representation of the second variant of the dial of the timepiece comprising a communication device according to a first embodiment of the invention.

In the second variant of the dial 1 illustrated in FIGS. 5 and 6, the communication device 4 comprising the chip 6 connected to at least one antenna 5 is disposed in the area of the lower surface 11*b* of the dial 1. More precisely, the chip 6 and the antenna 5 can be secured to the lower surface 11*b* by gluing or by fitting into fixation elements present on this lower surface 11*b*. Alternatively, the antenna 5 can be disposed on the lower surface 11*b* by printing, silk screening, or vapour deposition of a metallized paint.

In this variant of the dial 1, the alternative of the communication device 4 comprising the substrate 16 made of plastic or laminated composites on which the chip 6 and the antenna 5 are glued can likewise be arranged on the lower surface 11*b*, especially by gluing.

In this variant, when the communication device 4 is associated with the magnetic screen 8, the latter is then arranged on the lower surface 11*b* so as to cover the communication device 4. More precisely, this magnetic screen 8 can be arranged beneath the antenna 5 or the antenna 5 and the chip 6 by being situated between the lower surface 11*b* and the movement. In this configuration, this magnetic screen 8 comprises at least one layer, one film or one metallic deposit which is able to cover the communication device 4 arranged on the lower surface 11*b*. Thus, the antenna 5 or the antenna 5 and the chip 6 of the communication device 4 are comprised between the magnetic screen 8 and the lower surface 11*b*. This magnetic screen 8 can be applied to the lower surface 11*b* so as to cover the communication device 4 by the techniques of printing, silk screening, gluing, or vapour deposition of a metallic paint.

It will be noted that this second variant is particularly adapted to the dial 1 having feet arranged on the peripheral wall 25 of the latter. In fact, in such a configuration, the communication device 4 and in particular the antenna can be arranged on a larger portion of the lower surface 11*b* due to the absence of feet 34 of the dial 1 on the lower surface 11*b*.

Figure 7:
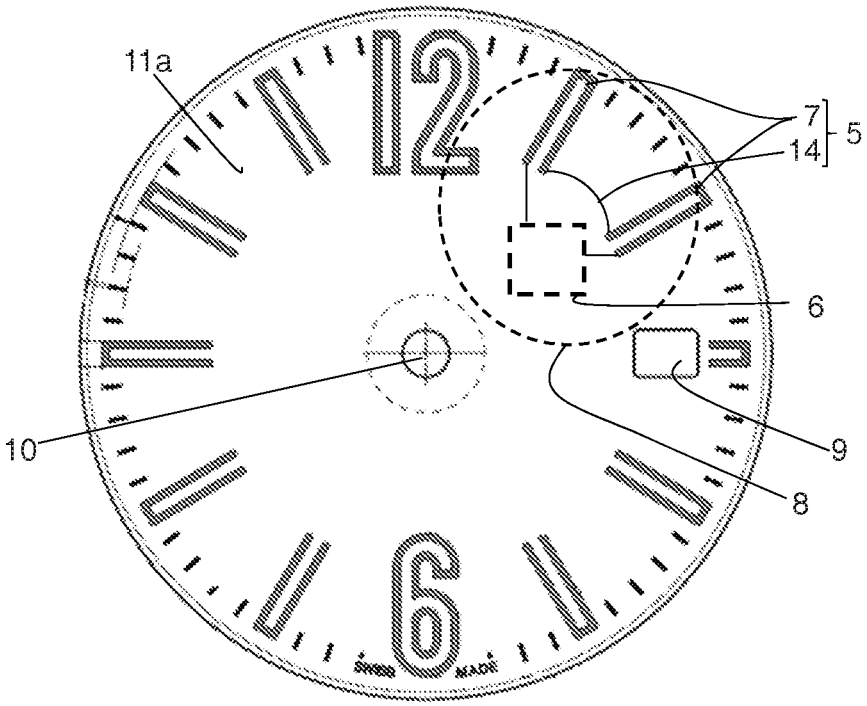
FIG. 7 represents schematically a third variant of the dial according to the first embodiment of the invention.

In the third variant of the dial 1 illustrated in FIG. 7, the communication device 4 is arranged on the upper surface 11*a* of the dial 1. More precisely, in this variant the antenna 5 of this communication device 4 can be formed by at least one metallic element corresponding, for example, to a metallic wire, a layer, a film, or a metallic deposit. This element can be disposed on the upper surface 11*a* by the different alternatives, not exhaustive and nonlimiting, defined below.

In fact, in a first alternative illustrated in FIG. 7, the antenna 5 can be a metallic element having markings 7 present on this upper surface 11*a* which can be connected to each other by a component 14 of the metallic element. In this context, the markings 7 and the component 14 are made of metallic material, such as copper or aluminium.

In a second alternative, the antenna 5 can be a metallic element which is arranged in the area of the peripheral zone defined on the upper surface 11*a* of the dial 1 where the markings 7 are situated. In this case, the metallic element extends into this peripheral zone, making at least one turn around the dial 1 and hugging the markings 7.

In a third alternative, the metallic element can be arranged on the upper surface 11*a* in the area of the peripheral edge 27*a* defined on this upper surface 11*a* or, optionally, between the markings 7 and this edge 27*a*.

In these alternatives, the metallic element is preferably arranged on the upper surface 11*a* by overmoulding in the thickness of the dial 1 or by injection moulding so that it is not apparent. The metallic element can likewise be applied to the upper surface 11*a* by the techniques of printing, silk screening, etching, gluing, or vapour deposition of a metallic paint, and in this case it will be visible on the upper surface 11*a* of this dial 1 so as to constitute, for example, a motif having an aesthetic form.

It will be noted that when the markings 7 form with the component 14 an antenna 5, these markings 7 can then be made by the techniques mentioned above, such as printing, silk screening, gluing, or vapour deposition of a metallic paint.

In this variant, the antenna 5 is then connected to the chip 6 of the communication device 4. This chip 6 is arranged on the upper surface 11*a* of the dial 1 by an overmoulding or an injection moulding technique so as not to be apparent. The chip 6 can likewise be applied to the upper surface 11*a* by a gluing technique and in this case it will be visible on the upper surface 11*a* of this dial 1 so as to constitute, for example, a motif having an aesthetic form.

In this variant of the dial 1, when the communication device 4 is associated with the magnetic screen 8, the latter is arranged on the lower surface 11*b* of the dial 1. It can likewise be arranged on the upper surface 11*a*, being situated beneath the antenna 5 or the antenna 5 and the chip 6. In this configuration, this magnetic screen 8 comprises at least one layer, one film or one metallic deposit which is able to be applied to one or the other of the two surfaces 11*a*, 11*b* of the dial 1 by the techniques of printing, silk screening, gluing, or vapour deposition of a metallic paint. Alternatively, this magnetic screen 8 can be arranged in the dial 1 by a technique of overmoulding or injection moulding, being comprised beneath the antenna 5 or the antenna 5 and the chip 6.

Figure 8:
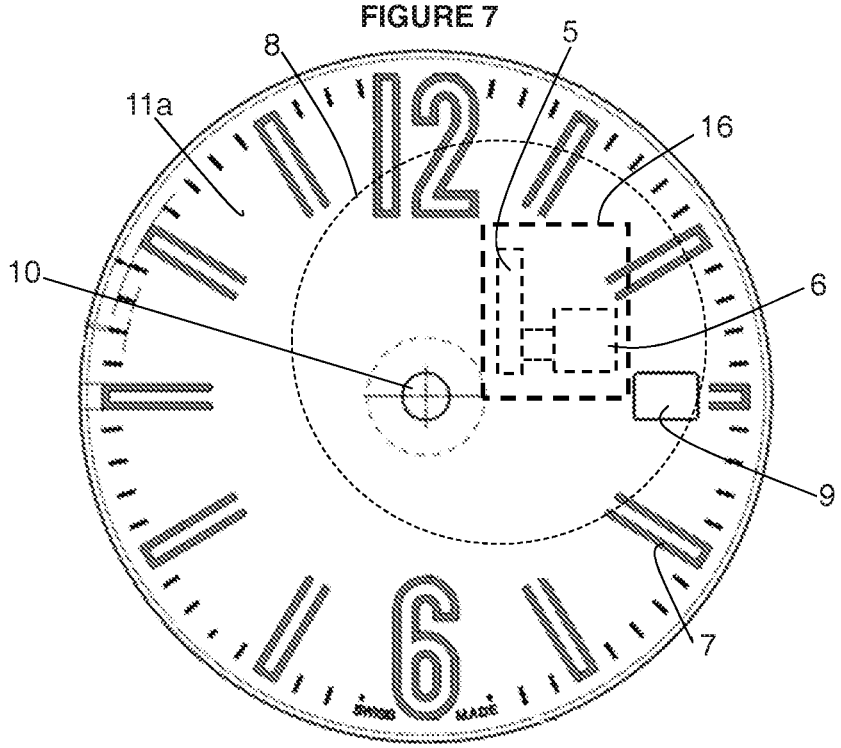
FIG. 8 represents schematically a fourth variant of the dial according to the first embodiment of the invention.

In a fourth variant of the dial 1 illustrated in FIG. 8, the communication device 4 is arranged in the dial 1 between the upper and lower surfaces 11*a*, 11*b*. In this configuration, the communication device 4 can have a substrate 16 made of plastic or of laminated composites on which the chip 6 and the antenna 5 are glued. The communication device 4 is then mounted in the dial 1 by a technique of overmoulding or injection moulding.

In this variant of the dial 1, when the communication device 4 is associated with the magnetic screen 8, the latter is arranged on the lower surface 11*b* of the dial 1. In this configuration, this magnetic screen 8 comprises at least one layer, one film, or one metallic deposit and it can be applied to the lower surface 11*b* of the dial 1 by the techniques of printing, silk screening, gluing, or vapour deposition of a metallic paint. Alternatively, this magnetic screen 8 can be arranged in the dial 1 beneath the communication device 4 by a technique of overmoulding or injection moulding.

Thus, as we have mentioned above, in the second embodiment of the timepiece 35 the communication device 4 is arranged in the area of the bezel 2. This second embodiment defines two different variants of the bezel 2. In these two variants, the bezel 2 is made preferably of rigid material able to provide good strength and preferably having no electrical conductivity properties. This material may correspond, for example, to synthetic sapphire, ceramic, or also an injection moulded or cast polymer such as polyamide-nylon PA12, polycarbonate PC or polyphenylsulfone PPSu. This bezel 2 can be circular in shape and comprise a lower surface 23*b* as well as an upper surface 23*a*. This upper surface 23*a* can constitute a visible display surface containing time indicator markings.

In the first variant of the bezel 2 illustrated in FIG. 9, the communication device 4 is arranged in the bezel 2. More precisely, in this variant, the bezel 2 is a monobloc piece whose lower surface 23*b* contains a pocket 18 in which the communication device 4 can be positioned. This pocket 18 forms a throat or an annular groove extending into the lower surface 23*b* of the bezel 2. This pocket 18 has a transverse section which can have the shape of a U. Such a pocket 18 has a bottom wall 19*a* and a lateral wall 19*b*, the lateral wall 19*b* being preferably perpendicular to the bottom wall 19*a*. The bottom wall 19*a* and the lateral wall 19*b* each have an essentially planar surface.

The lateral wall 19*b* of this pocket 18 forms, with a portion 29 of the lower surface 23*b* not constituting this pocket 18, an edge 28 which defines an opening of the pocket 18.

In this variant, the opening of this pocket 18 is defined on around 30 to 70% of the lower surface 23*b*, and preferably 50% of this surface 23*b*. This pocket 18 has a depth P2 of around 200 to 2500 preferably 1000 μm.

The communication device 4 comprising the chip 6 connected to at least one antenna 5 is disposed in the pocket 18 formed in the bezel 2. More precisely, the chip 6 and the antenna 5 can be secured to the bottom wall 19*a* and/or the lateral wall 19*b* by gluing or by fitting into fixation elements present on the bottom wall 19*a* and/or the lateral wall 19*b* of the pocket 18. Alternatively, the antenna 5 can be disposed on the bottom wall 19*a* and/or the lateral wall 19*b* by printing, silk screening, or vapour deposition of a metallized paint.

In this variant of the bezel 2, the alternative of the communication device 4 comprising the substrate 16 made of plastic or laminated composites on which the chip 6 and the antenna 5 are glued can likewise be arranged in this pocket 18, especially by gluing or by fitting, or by being driven in by mechanical resistance through dimensional adjustment.

In this variant of the bezel 2, when the communication device 4 is associated with the magnetic screen 8, the opening of the pocket 18 is wholly or partly covered by the magnetic screen 8 so as to optimize the performance of the communication device 4. This magnetic screen 8 has a zone of fixation which is mechanically connected by gluing, by fitting, or by welding to the edge 28 of the opening of the pocket 18, namely, to the portion 29 of the lower surface 23*b*. Alternatively, the magnetic screen 8 can have a shape essentially complementary to that of the opening so that it can be arranged therein by fitting or gluing and thus cover all or part of this opening of the pocket 18. In this case, the magnetic screen 8 is preferably rigid and the edge 28 of the opening has a fitting zone able to cooperate with the contour of the magnetic screen 8.

Figure 10:
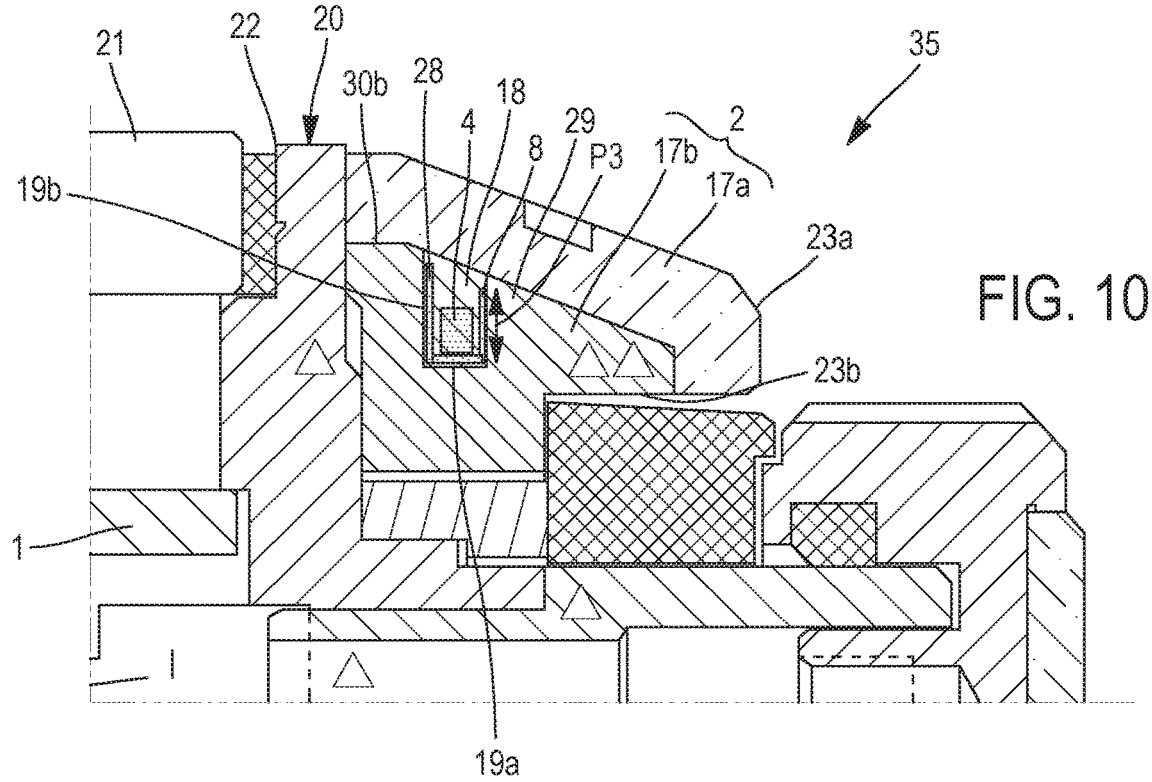
FIG. 10 represents a sectional view of the case of the timepiece comprising a second variant of the bezel according to the second embodiment of the invention.
Figure 11A:
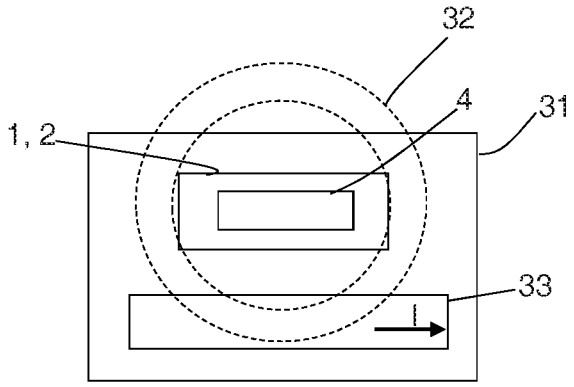
FIG. 11A is a schematic representation of a timepiece without a magnetic screen.
Figure 11B:
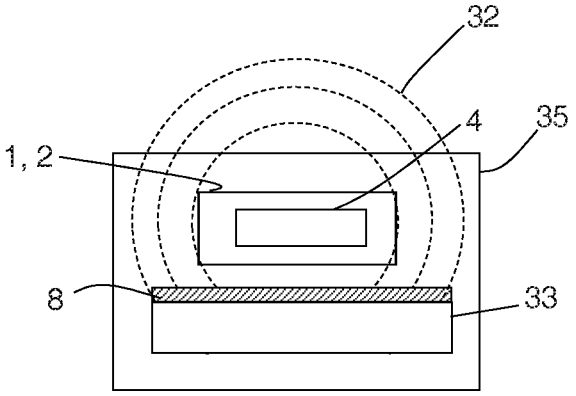
FIG. 11B is a schematic representation of the timepiece comprising the magnetic screen according to the first and second embodiments of the invention.

In a second variant of the bezel 2 illustrated in FIG. 10, the communication device 4 is arranged in the bezel 2. More precisely, in this variant, the bezel 2 has a first component 17*a* and a second component 17*b*. The first component 17*a* comprises the upper surface 23*a* of the bezel 2 and a first interior surface 30*a*, and the second component 17*b* contains the lower surface 23*b* of the bezel 2 and a second interior surface 30*b*. When the first component 17*a* is assembled with the second component 17*b* to form this variant of bezel 2, the first and second interior surfaces 30*a*, 30*b* are arranged opposite each other, being in contact for all or some of their surface. These first and second interior surfaces 30*a*, 30*b* have connection elements. The connection elements of each of these first and second surfaces 30*a*, 30*b* can have complementary shapes in order to ensure a mechanical connection between these two components 17*a*, 17*b* when they are assembled with each other.

In this variant, the second interior surface 30*b* of the second component 17*b* has a pocket 18 in which the communication device 4 can be arranged. This pocket 18 forms a throat or an annular groove extending into the second interior surface 30*b* of the second component 17*b* of the bezel 2. This pocket 18 has a transverse section which can have the shape of a U. Such a pocket 18 has a bottom wall 19*a* and a lateral wall 19*b*, each having an essentially planar surface, the lateral wall 19*b* being preferably perpendicular to the bottom wall 19*a*.

The lateral wall 19*b* of this pocket 18 forms, with a portion 29 of the second interior surface 30*b* not constituting this pocket 18, an edge 28 which defines an opening of the pocket 18.

In this variant, the opening of this pocket 18 is defined on around 30 to 70% of the second interior surface 30*b*, and preferably 50% of this surface. This pocket 18 has a depth P3 of around 200 to 2500 μm, preferably 1000 μm.

In this variant, when the communication device 4 is associated with the magnetic screen 8, the latter is arranged in the pocket 18. This magnetic screen 8 can correspond to a layer, a film or a metallic deposit which is applied to the bottom wall 19*a* and/or the lateral wall 19*b* of the pocket 18. The application of this magnetic screen 8 in the pocket 18 can be done by a technique of printing, silk screening, or vapour deposition of a metallized paint.

The communication device 4 is then disposed in the pocket 18 above the magnetic screen 8. More precisely, the chip 6 and the antenna 5 can be fixed to at least one support element comprised on the bottom wall 19*a* and/or the lateral wall 19*b* by gluing or by fitting so that the antenna 5 of the communication device 4 is not in contact with the magnetic screen 8. The support element can correspond to at least one fixation arm or to a layer of material. This layer of material can cover all or part of the magnetic screen 8 arranged in the pocket 18, and have electrical insulating properties. Alternatively, the communication device 4 can be fixed in a connection zone defined on the first interior surface 30*a* of the first component 17*a*. This connection zone is situated opposite the pocket 18 when the first and second components 17*a*, 17*b* are assembled with each other.

In this variant of the bezel 2, the alternative of the communication device 4 comprising the substrate 16 made of plastic or laminated composites on which the chip and the antenna 5 are glued can likewise be arranged in this pocket 18, especially by the same principles mentioned above for this second variant.

In this second variant, the opening of this pocket 18 is then closed when the first component 17*a* is assembled with the second component 17*b* to form the bezel 2.

In these two embodiments of the invention, the communication device 4 and the magnetic screen 8 can be comprised in a module for example by being overmoulded in the same piece of polymer. Such a module can then be arranged in the dial 1 and the bezel 2 according to the different variants described above. The arrangement of this module in these different variants is preferably done so that the antenna 5 radiates optimally in the direction of the associated peripheral with which the timepiece 35 is able to exchange data.

In this timepiece 35, the case 20 is adapted to optimize/maximize the performance of the communication device 4 arranged in the area of the bezel 2 or the dial 1. In fact, this case 20 can be made in whole or in part of a material having no electrical conductivity properties, such as synthetic sapphire, ceramic, or also an injection moulded or cast polymer such as polyamide-nylon PA12, polycarbonate PC or polyphenylsulfone PPSu. Thus, the case 20 can be made wholly of this material. But alternatively the case 20 can be made only partly of this material, having only some of these components designed in this material, such as the components which are situated on top of the dial 1, such as a portion of the caseband situated above the level of the dial 1 and the bezel 2.

Thus, as we have mentioned above, the dial 1, the bezel 2, or even all or some of the case 20 can be made of a material having no electrical conductivity properties. The electrical nonconductivity of such a material is quantified by its resistivity, which characterizes its capacity to resist the flow of electric current. The resistivity of this material is greater than $10^{12}$ Ω/cm, and preferably greater than $10^{13}$ Ω/cm.

It will be noted that the arrangement of the communication device in upper portions of the timepiece such as the dial 1 and the bezel 2 makes it possible to limit the perturbation effects which may result from the wristband of the wearer of said timepiece 35.

The present invention is not limited to the embodiments which have been explicitly described, but also includes the different variants and generalizations contained in the realm of the following claims.

The invention claimed is:

1. Timepiece comprising:

a bezel comprising a near field communication device able to receive/send a signal, wherein the communication device comprises a chip and an antenna and is arranged in a pocket of the bezel of the timepiece, the communication device being associated with a magnetic screen, and wherein the magnetic screen is located on a bottom wall and on at least two opposed lateral walls of the pocket.

2. The timepiece according to claim 1, wherein the bezel is a monobloc piece comprising a lower surface having the pocket in which the communication device is arranged.

3. The timepiece according to claim 1, wherein the bezel is made of a material having no electrical conductivity properties.

4. The timepiece according to claim 1, wherein the magnetic screen comprises at least one selected from the group consisting of (i) at least one layer, (ii) at least one plate, (iii) at least one film and (iv) at least one metallic deposit.

5. The timepiece according to claim 1, wherein the communication device comprises a substrate made of plastic or laminated composites on which are glued the chip and the antenna.

6. The timepiece according to claim 1, wherein the communication device is of a Near Field Communication (NFC) or Radio Frequency Identification (RFID) technology type.

7. The timepiece according to claim 1, wherein the magnetic screen is made of ferrite.

8. The timepiece according to claim 4, wherein the magnetic screen comprises at least one metallic deposit of ferrite.

9. The timepiece according to claim 1, wherein the bezel comprises first and second components, the second component comprising a second interior surface, and wherein the pocket has an opening provided on the second interior surface.

10. The timepiece according to claim 1, wherein the magnetic screen comprises at least one selected from the group consisting of (i) at least one layer, (ii) at least one film, and (iii) at least one metallic deposit.

11. The timepiece according to claim 10, wherein the magnetic screen comprises a printed, silk-screen-applied, or vapor-deposited metallic paint.

* * * * *